US008051696B2

(12) United States Patent
Yoshida et al.

(10) Patent No.: US 8,051,696 B2
(45) Date of Patent: Nov. 8, 2011

(54) PRESS FORMING METHOD FOR ALUMINUM ALLOY SHEET AND PRESSING DEVICE

(75) Inventors: Masatoshi Yoshida, Kobe (JP); Haruyuki Konishi, Kobe (JP); Takeo Sakurai, Moka (JP)

(73) Assignee: Kobe Steel, Ltd., Kobe-shi (JP)

( * ) Notice: Subject to any disclaimer, the term of this patent is extended or adjusted under 35 U.S.C. 154(b) by 601 days.

(21) Appl. No.: 12/162,520

(22) PCT Filed: Mar. 7, 2007

(86) PCT No.: PCT/JP2007/054423

§ 371 (c)(1),
(2), (4) Date: Jul. 29, 2008

(87) PCT Pub. No.: WO2007/102538

PCT Pub. Date: Sep. 13, 2007

(65) Prior Publication Data

US 2009/0038365 A1 Feb. 12, 2009

(30) Foreign Application Priority Data

Mar. 8, 2006 (JP) ..... 2006-063051
Nov. 7, 2006 (JP) ..... 2006-301813

(51) Int. Cl.
*B21D 22/00* (2006.01)

(52) U.S. Cl. ..... 72/347; 72/350

(58) Field of Classification Search ..... 72/347, 72/348, 350, 379.2, 381, 382, 383, 384
See application file for complete search history.

(56) References Cited

U.S. PATENT DOCUMENTS

| | | | | | |
|---|---|---|---|---|---|
| 4,121,448 | A * | 10/1978 | Censuales | 72/348 |
| 5,263,887 | A * | 11/1993 | Cagna et al. | 445/47 |
| 5,600,991 | A * | 2/1997 | Munzen | 72/348 |
| 5,901,599 | A * | 5/1999 | Sato et al. | 72/350 |
| 5,918,499 | A * | 7/1999 | Langlasse et al. | 72/356 |
| 6,539,767 | B2 * | 4/2003 | McClung | 72/336 |
| 6,830,419 | B1 * | 12/2004 | Turner et al. | 413/8 |
| 7,237,423 | B1 * | 7/2007 | Nagel et al. | 72/350 |

FOREIGN PATENT DOCUMENTS

| | | |
|---|---|---|
| EP | 1 410 856 A1 | 4/2004 |
| EP | 1 415 735 A1 | 5/2004 |

(Continued)

*Primary Examiner* — Edward Tolan
(74) *Attorney, Agent, or Firm* — Oblon, Spivak, McClelland, Maier & Neustadt, L.L.P.

(57) ABSTRACT

The invention provides a press forming method of an aluminum alloy sheet and a press device capable of forming a large panel which is an automobile body outer panel such as a luggage outer panel and the like and is of a shape difficult in forming. In a method of press forming of the aluminum alloy sheet 30 into a formed product panel having non-contact outer peripheral parts 5, 6 not contacting the punch for forming the center part of the panel until the vicinity of the bottom dead point, the first punch forming the center part 2 of the panel and the second punch 15 capable of shifting independently with respect to the first punch are provided, and these punches are interlocked with each other so that the second punch 15 is made contact the non-contact outer peripheral parts 35, 36 of the sheet with the relative position of the second punch 15 with respect to the first punch 11 being shifted to the dice 22 side.

4 Claims, 6 Drawing Sheets

FOREIGN PATENT DOCUMENTS

| | | |
|---|---|---|
| JP | 63 299822 | 12/1988 |
| JP | 63-299822 | 12/1988 |
| JP | 1-306022 | 12/1989 |
| JP | 2-22219 | 2/1990 |
| JP | 2 22219 | 2/1990 |
| JP | 2000 158050 | 6/2000 |
| JP | 2000-158050 | 6/2000 |
| JP | 2000-355724 | 12/2000 |
| JP | 2000 355724 | 12/2000 |
| JP | 2001 58218 | 3/2001 |
| JP | 2004 188445 | 7/2004 |
| JP | 2005-297048 | 10/2005 |

* cited by examiner

65mm UP FROM
BOTTOM DEAD POINT

32mm UP FROM
BOTTOM DEAD POINT

65mm UP FROM
BOTTOM DEAD POINT

32mm UP FROM
BOTTOM DEAD POINT

PRESS FORMING METHOD FOR ALUMINUM ALLOY SHEET AND PRESSING DEVICE

TECHNICAL FIELD

The present invention relates to a press forming method of an aluminum alloy sheet and a press device enabling forming of a large panel which is difficult to form such as an automobile body outer panel. Hereafter, aluminum is referred to also as Al.

BACKGROUND ART

As is well known, an aluminum alloy panel also is used instead of a steel (steel sheet) panel for an outer panel (outer sheet) and an inner panel (inner sheet) and the like of a panel structure such as a hood (bonnet), fender, door, luggage (trunk lid), roof, and the like, of an automobile. For these aluminum alloy panels, similar to the case of steel sheet, a panel formed product (press formed product, hereafter referred simply to also as panel), which is a press molded product of an aluminum alloy sheet (blank, a material sheet for panel forming) by a mold, is used.

Among them, the outer panel such as a hood, luggage and the like has become difficult particularly in press forming because of diversification of automobile (panel) design in recent years also. Its reason originates in inferior forming performance of an aluminum alloy sheet compared to a steel sheet, as well as in the shape itself of these outer panels.

One example of a luggage outer panel is exhibited in the perspective view drawing of a rear part of an automobile body in FIG. 11. As exhibited in FIG. 11, a luggage outer panel 1 comprises a high (large) ridge line part (ridge part) 2 extending in the vehicle body width direction, and two or more long (large) curved face parts (or projected peripheral edge parts, outline parts) 3, 4 surrounding the ridge line part 2, in the center part (top part) of the panel. And this ridge line part 2 often has a character line of a semicircular (curved) shape in a plan view as exhibited in FIG. 11 for the design of the vehicle body. Further, 9 in FIG. 11 is a license seat (recessed part) to which a number plate is mounted.

When such a luggage outer panel 1 having a semicircular large ridge line part is manufactured by stretch forming by a press device from an aluminum alloy sheet which is a forming material sheet, a wrinkle particularly is liable to occur on the formed face surface of the formed product panel. In other words, as a press formed product panel of FIG. 10 described below, a wrinkle is liable to occur in a portion exhibited as X extending from curved faces 3, 4 to a ridge line part 2.

Occurrence of such a wrinkle is a problem peculiar to the case that the product with such shape of the luggage outer panel 1 having the semicircular large ridge line part 2 is stretch formed with an aluminum alloy sheet. This is because the ridge line part 2 pulls the material sheet unevenly, material excess for material flow-in is liable to occur, the material sheet part of an end part does not contact a punch until the vicinity of the bottom dead point (hereafter referred to also as non-contact outer peripheral part), and deforms freely. Such problem of occurrence of a wrinkle is a problem peculiar to the formed product panel having the non-contact outer peripheral part. In other words, in an ordinary sheet-like panel formed product without such a non-contact outer peripheral part or not in the shape with the ridge line part 2 and the curved face parts 3, 4, the problem of occurrence of such a wrinkle is hard to be caused.

Ordinary method in the case such luggage outer panel 1 is stretch formed by a press device is explained by FIGS. 12(*a*), (*b*) exhibiting the condition of the sheet and the press device during pressing. FIG. 12(*a*) is a perspective view drawing showing the deform condition of the aluminum alloy sheet in the course of pressing, and FIG. 12(*b*) is a perspective view drawing when the press device and the aluminum alloy sheet are cut and viewed at section B of FIG. 12(*a*). Ordinarily, an aluminum alloy sheet 30 is formed, with a peripheral edge part 31 of the aluminum alloy sheet 30 being held by a dice 22 and a blank holder (a wrinkle press member) 20, and with the dice 22 being moved (lowered) relatively toward the punch 11 fixed on a bolster (base) 21.

Then, in the aluminum alloy sheet during forming, parts of sheets 33, 34 between a top part 32 corresponding to the ridge line part 2 of the luggage outer panel and the peripheral part 31 held by the blank holder 20 correspond to the curved face parts 3, 4 of the luggage outer panel.

In the panel in the course of forming exhibited in FIG. 12(*a*), section A in the center part of the product is in a shape wherein its peak is higher than that of section B which is in a position shifted from the center of the product because the ridge line of the panel is in a nearly arc shape. In other words, the line length 1A (1A') of section A is longer than the line length 1B (1B') of section B, and line length difference occurs between both sections A, B. When line length difference occurs between neighboring 2 sections like this, uneven tensile force is liable to act as described previously and material excess is liable to occur, therefore the non-contact outer peripheral part occurs wherein the material sheet part of the end part does not contact with the punch until the vicinity of the bottom dead point. Because this non-contact outer peripheral part freely deforms, a wrinkle becomes liable to occur in X and the like exhibited in the drawing as described above.

As a countermeasure to this, as the section of the press device is exhibited partly in FIG. 13, the method wherein excess material forming parts 19, 26 are provided in inner side of the blank holder 20 and tensile force accompanying excess material forming is applied to the sheet 30 is common. In other words, the method is commonly used wherein, by providing this excess material in the periphery part of the sheet 30, the sheet 30 contacts a mold which shapes the excess material part from early stage of press forming and tensile force is applied during shaping of excess material, thereby occurrence of a wrinkle described above is prevented.

Also, apart from this, a method is proposed, wherein, when an aluminum alloy hood outer panel having a large folding part in its end part is press formed, the forming face center part of a sheet where occurrence of recessed parts becoming the cause of a wrinkle is foreseen is formed beforehand prior to start of wrinkle pressing or upon start of wrinkle pressing (refer to the patent document 1, for example). In this method, the height of the panel (product) forming face of the punch is raised by a predetermined size from the top face of the wrinkle press member, and the forming face center part of the sheet is formed beforehand.

Further, a method is also proposed wherein an aluminum alloy sheet is press formed molded to an automobile hood outer panel which has a shape having a large folding section and a border line connecting this folding section and a panel body part being curved toward the front of the panel body (refer to the patent document 2, for example). In other words, this is a method wherein, so that a part corresponding to the wrinkle press face during press forming out of the parts of sheet end part corresponding to the folding section becomes a shape adapting to the wrinkle press member face shape during press forming, the aluminum alloy sheet end part is bent beforehand and a bending part is formed, thereafter press molding is carried out with wrinkle pressing being performed for the portion including a part corresponding to the wrinkle press face of the folding section. In addition, it is also proposed that the prior bending work of the aluminum alloy sheet end part is performed by a divided punch which moves independently from the part of the punch for forming of the panel body.

Patent document 1: Japanese Unexamined Patent Application Publication No. 2001-58218 Bulletin (whole text)

Patent document 2: Japanese Unexamined Patent Application Publication No. 2004-188445 Bulletin (whole text)

DISCLOSURE OF THE INVENTION

Problems to be Solved by the Invention

In the common method of preventing occurrence of a wrinkle wherein an excess material part formed in the periphery of the material sheet described above is formed, that is, a method wherein tensile force is applied to the material sheet by performing excess material forming in the peripheral part of the sheet 30 described above in FIG. 13, wrinkle inhibiting effect cannot be fully exerted. In other words, in this method, excess material forming is not started unless a punch 11 gets fully close to the dice 22, because an excess material shape part 19 contributing to excess material forming is shaped integrally with the punch 11. Consequently, in this method, a mold and a material sheet do not contact in the vicinity of the product end part until comparatively late stage of forming, and the free deformation of the non-contact outer peripheral part leading to occurrence of a wrinkle cannot be restrained. Also, because the contact timing of the material sheet and the mold becomes the latter stage of forming, the tensile strength in the early stage of forming which is important in inhibiting a wrinkle is not generated, and wrinkle inhibiting effect cannot be exerted fully.

In contrast, to secure deformation restraining against the material sheet and the tensile force effect by making the mold of the excess material part contact the material sheet from the former half of forming, it is necessary to make the height of the projected part of the excess material shape part 19 disposed on the punch 11 and the depth of the recessed part of an excess material shape part 26 disposed on the dice extremely large. However, in such a case, extremely deep excess material is formed in the peripheral part the sheet 30 in the vicinity of the bottom dead point of forming, and excessive tensile force becomes applied to the sheet 30. Therefore, in the luggage outer panel and the like which is the object of the present invention, the tendency of the thickness reduction of the part corresponding to the ridge line part 2 of the luggage outer panel or the excess material part 15 and the like becomes larger, and in some cases, the breakage of the sheet is possibly caused.

Thus, in the luggage outer panel and the like which is the object of the present invention, if the excess material required for prevention of a wrinkle is provided, this tendency of thickness reduction becomes unignorably large, and the crack in the panel ridge line part 2 and the excess material part 15 and the like becomes liable to occur. Therefore, prevention of occurrence of a wrinkle and prevention of occurrence of a crack cannot be made co-exist in the common method of preventing occurrence of a wrinkle wherein the excess material part shaped in the periphery of the material sheet is formed.

Also, in the case of the panel whose profile of the panel ridge line part 2 is not of semicircular shape (curved shape) described above but nearly straight, the method of the patent document 1 is effective in inhibiting a wrinkle as far as it goes. However, for such luggage outer panel as those being the object of the present invention, the non-contact outer peripheral part leading to occurrence of a wrinkle still exists, free deformation of this non-contact outer peripheral part cannot be restrained, and the effect of prevention of occurrence of a wrinkle is low. Further, the method of the patent document 2 is unique in that the ridge line part 2 in the luggage outer panel is shaped by bending work of the sheet to the front-rear direction (vehicle body longitudinal direction) by a divided punch. However, setting of the condition of the bending work of the sheet in the front-rear direction and the design condition of the divided punch is difficult, and there is a problem in this respect that it is not practical.

Furthermore, with regard to the forming method by such a divided punch, there is another "bring-in forming method" commonly used for prevention of a crack. In this method, a local (partial) movable part is provided in a panel body forming part (center part, for example) of the punch side, a blank is pushed up by the local movable punch part, the brought-in amount of the material into the mold from the circumference is increased, and a crack is prevented. However, in this crack preventing method, prevention of occurrence of a wrinkle and prevention of occurrence of a crack cannot be made co-exist for the luggage outer panel and the like which is the object of the present invention. That is, because the brought-in amount of the material into the mold by the local movable punch part increases, the remainder of a blank, that is, the non-contact peripheral part that does not contact with the punch described above forming the center part of the panel until the vicinity of the bottom dead point becomes large on the contrary, and a wrinkle becomes liable to occur more in the formed panel.

In the meantime, although there are still these problems in forming, a need to apply an aluminum alloy sheet of an Al—Mg—Si series (6000 series) and the like with excellent bake hardening performance and recycling performance and with high yield strength to automobile body outer panels is increased more and more for necessity of lightening of automobiles for environmental protection of the earth and vehicle body safety enhancement by energy absorbing performance.

Taking notice of such situations, the present invention is to provide a press forming method of an aluminum alloy sheet and a press device enabling formation of a large panel which is an automobile body outer panel such as a luggage outer panel and the like with a shape with which forming is difficult.

Means to solve the Problems

An essential point of a press forming method of an aluminum alloy sheet of the present invention for attaining the purposes described above is, a method of press forming of an aluminum alloy sheet into a formed product panel having a non-contact outer peripheral part not contacting a punch for forming a center part of the panel until the vicinity of the bottom dead point wherein, in press forming the aluminum alloy sheet by providing a first punch forming the center part of the panel and a second punch capable of displacing independently with respect to the first punch and the first punch and a dice are relatively moved while an outer peripheral part of the aluminum alloy sheet is held by a blank holder disposed in an outer periphery of the dice, the punches are interlocked with each other so that the second punch is made contact the non-contact outer peripheral part in the aluminum alloy sheet with the relative position of the first punch with respect to the second punch being shifted to the dice side compared with the relative position of the second punch with respect to the first punch at the bottom dead point of the press at one point of time at least between the time of start of the press forming and the bottom dead point.

A preferred aspect of a press forming method of an aluminum alloy sheet of the present invention for attaining the purposes described above is that the non-contact outer peripheral part where the second punch contacts is to be an excess material part of the formed product panel. Also, the second punch is to have a nearly annular shape disposed around the first punch.

Further, another preferred aspect is that, when press forming of the aluminum alloy sheet starts, a relative position of the second punch with respect to the first punch is to be shifted beforehand to a dice side compared with a relative position of the second punch with respect to the first punch at the bottom dead point of the press. Also, the center part of the panel is to be formed by the first punch after the second punch is made contact the non-contact outer peripheral part.

Also, another preferred aspect is that, unevenness or a step is to be provided on the contact face of the second punch to an aluminum alloy sheet, and unevenness or a step corresponding to the unevenness or the step described above is to be provided also on the contact face to the aluminum alloy sheet in the dice side corresponding to it. Further, a shifting amount of the second punch relative to the dice side is to be 80 mm or less.

It is preferable that a formed product panel which is an object of the present invention has a ridge line in the center part and is constituted of at least two or more curved faces surrounding the ridge line. Also, a ridge line part of a formed product panel preferably has a semicircular character line. Such formed product panel preferably is an automobile body outer panel selected from a hood, fender, door, luggage (trunk lid), and roof.

On the other hand, the press formed aluminum alloy sheet preferably is Al—Mg—Si series aluminum alloy of 130 MPa or more of 0.2% proof stress.

An essential point of a press device of an aluminum alloy sheet of the present invention for attaining the purposes described above is a press device to be used for press forming method with an essential point described above, a preferable essential point described above, or preferable essential point described below, and to press form an aluminum alloy sheet into a formed product panel having a non-contact outer peripheral part which does not contact a punch forming the center part of the panel until the vicinity of the bottom dead point, wherein a first punch to form the center part of the formed panel and a second punch capable of displacing independently with respect to the first punch are provided, and these punches are interlocked with each other so that the relative position of the second punch with respect to the first punch is shifted to a dice side compared with the relative position of the second punch with respect to the first punch at the bottom dead point of the press and can contact the non-contact outer peripheral part in the aluminum alloy sheet at one point of time at least between the time of start of press forming and the bottom dead point.

Effect of the Invention

As the essential points described above, the present invention is characterized in that a first punch to form the center part of the panel is made to contact the non-contact outer peripheral part of further outside (outer peripheral part) of the center part of a formed panel using at least one or more second punch capable of shifting independently from it.

That is, in the present invention, first, a first punch to form the center part of the panel and a second punch which contacts the non-contact outer peripheral part (the part not contacting the first punch until the vicinity of the bottom dead point of the panel) are provided, or a punch for forming is divided to these first and second punches and the second punch is constituted to be able to shift independently with respect to the first punch.

Also, in the present invention, the area where the first punch forms is not only the center part of the panel only but also may of course include the portion necessary to form in the vicinity of the center part or in the circumference of the center part. Accordingly, the expression of a first punch to form the center part of the panel means a first punch to form the center part only of the panel, or to form including the vicinity of the center part and the circumference of the center part of the panel.

On the premise of above constitution, in the present invention, when a first punch to shape the center part of a formed panel forms an aluminum alloy sheet in co-working with a dice, the relative position of a second punch with respect to the first punch is shifted to a dice side compared with a relative position at the bottom dead position of a press at one point of time at least between the time of start of press forming and the bottom dead point. In other words, these punches are interlocked with each other so that the relative position of the second punch with respect to the first punch is shifted to a dice side compared with the relative position of the second punch with respect to the first punch at the bottom dead point of the press at one point of time at least between the time of start of the press forming and the bottom dead point.

Thus, it becomes possible that, when the first punch forms an aluminum alloy sheet in co-working with the dice, at least one or more second punch disposed around the first punch contacts the non-contact outer peripheral part (the part not contacting the first punch until the vicinity of the bottom dead point of the panel) or, further, forms this part at an early stage of forming, restrains wrinkle deformation in the end part of the material, and controls the tensile force applied to the material sheet. Further, the non-contact outer peripheral part referred to in the present invention has both meanings of the non-contact outer peripheral part of the formed product panel, and the non-contact outer peripheral part in the aluminum alloy sheet, which is a material of forming, corresponding to it, which are properly and discriminatingly used in the present invention.

In other words, even when the projected height of the ridge line in FIG. 12 exhibited above is high and the line length difference of sections A, B is large as a luggage outer panel and the like which is the object of the present invention, the non-contact outer peripheral part can be eliminated and tensile force can be applied over the entire area of the sheet (panel during forming). Therefore, restraining effect can be exerted for the wrinkle as well that occurs from a comparatively early stage of forming.

Further, if contact timing with each non-contact outer peripheral part is respectively controlled independently using a plurality of the second punches, tensile force applied to the material sheet can be finely controlled for respective location in accordance with the shape of the product. To exert this effect at maximum, the second punches are preferably disposed in a part corresponding to an excess material part disposed in the periphery of the product.

Also, the present invention has, in addition to effects of action of inhibiting a wrinkle (function of restraining a material sheet and applying tensile force by the second punch) described above, the effect that enables prevention of crack of the product (formed panel) by the second punch. In other words, because the second punch contacts the material sheet (non-contact outer peripheral part) from an early stage of the forming process by the first punch, restraining deformation of the material sheet and applying tensile force are possible. On the other hand, at the bottom dead point of the press, the relative position of the second punch with respect to the dice moves toward the punch side compared with that during press forming. Thus, the height of the excess material becomes low, and an effect can be provided that tensile force is not excessively increased in the vicinity of the bottom dead point of the press where breakage is liable to occur.

In other words, in the present invention, from the former half of the forming process when whether a wrinkle occurs or not is controlled, deformation of the material sheet part corresponding to the curved faces (3, 4) surrounding the ridge line of the formed panel is restrained, and ample strength force can be applied to the sheet. As a result, occurrence of a wrinkle can be prevented in the former half of the forming process, breakage by extreme reduction of the thickness of the material in the vicinity of the bottom dead point can be prevented because the tensile force level can be controlled to a certain value or below in the latter half of the forming process.

In particular, the aspect wherein the relative position of the second punch with respect to the first punch at the time point of the start of press forming is shifted to the dice side beforehand compared with the relative position at the bottom dead point of the press is preferable in terms of installations. In such an aspect, as forming proceeds and the first punch gets close to the bottom dead point, forming is performed with movement of the second punch toward the dice being stopped and with the condition the sheet is held in the gap against the dice being maintained. Such aspect of forming is possible by combination of a movable mold and a die cushion, and is attainable by comparatively simple mold constitution, and is preferable in terms of installations.

On the other hand, oppositely, if a mechanism to control the shift of the second punch with respect to the first punch independently is provided, although installations of the press device become complicated, the timing of contact of the material sheet and the mold and applying tensile force are more positively controllable, and the product (formed panel) which is more difficult in forming (a wrinkle and breakage being liable to occur) is press formed suitably.

As above, in the present invention, prevention of occurrence of a wrinkle and prevention of occurrence of a crack in the difficult forming described above can be made co-exist, and even the panel which is an automobile body outer panel made of an aluminum alloy such as a luggage outer panel and is of a shape difficult in forming becomes possible to form.

DESCRIPTION OF MARK

Figure 1A:
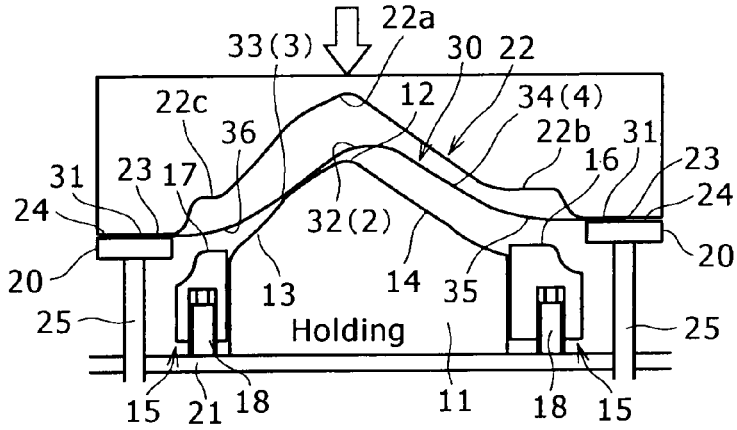
FIG. 1 Sectional view of the press device exhibiting an embodiment of a forming method of the present invention stepwise.
Figure 1B:
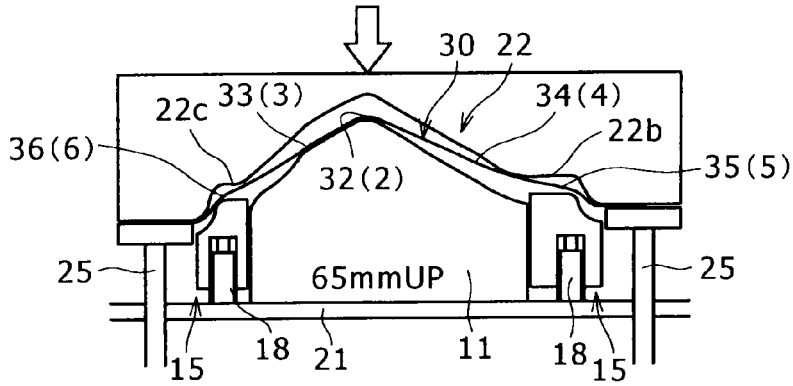
Figure 1C:
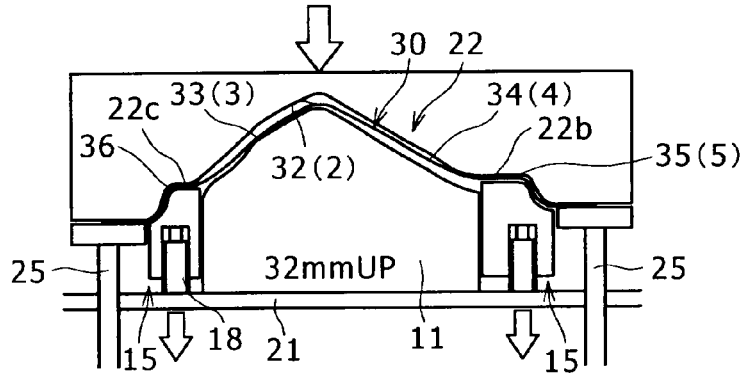
Figure 1D:
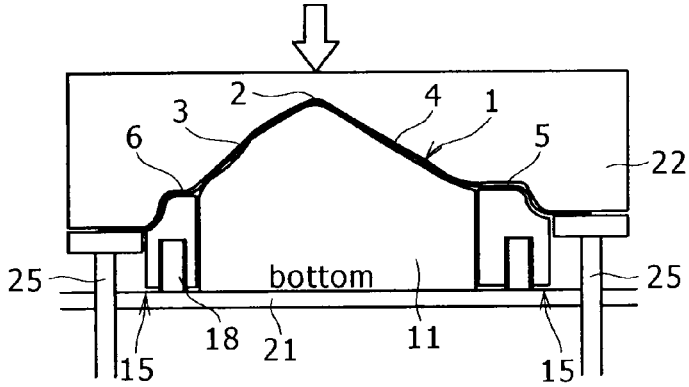

1: Luggage outer panel
2: Ridge line part
3, 4: Flat face part
5, 6: Non-contact outer peripheral part of a formed product panel (Excess material part of a formed product panel)
10: Press device
11: First punch
12: Ridge line part of a punch
13, 14: Flat face part of a punch
15: Second divided punch
16, 17: Excess material formed face
18: Gas spring
19, 26: Excess material formed part
20: Blank holder
21: Bolster
22: Dice
23, 24: Wrinkle press face
25: Cushion pin
30: Sheet
31: Ultimate peripheral edge part of a sheet
32: Part of a sheet corresponding to the ridge line part 2
33, 34: Part of a sheet corresponding to the flat face parts 3, 4
35, 36: Non-contact outer peripheral parts of a sheet (Excess Material Parts of a Sheet)

BEST MODE FOR CARRYING OUT THE INVENTION

Embodiments of the present invention will be described below in detail using FIGS. 1-10.

(Press Device)

Figure 2:
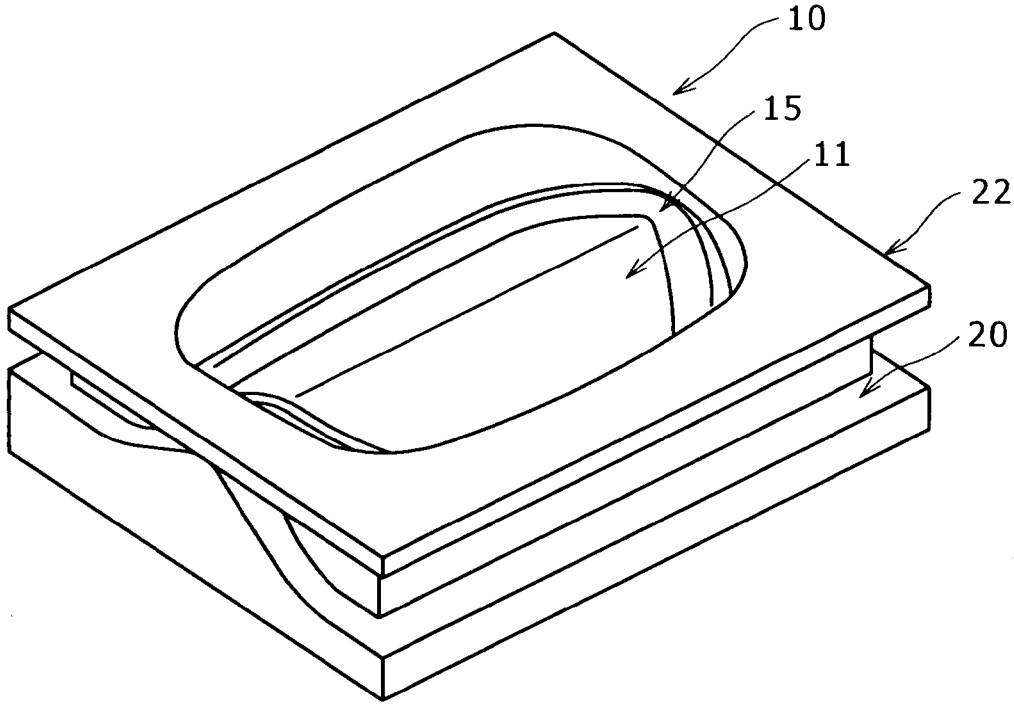
FIG. 2 Perspective view exhibiting an embodiment of a mold in relative with the present invention.

First, the press device used in the present invention will be described using FIGS. 2-8. FIG. 2 exhibits an aspect of a combination of an upper mold (dice: FIG. 2 exhibits a peripheral part only except the center part corresponding to the center of the formed product) 22, and a first punch 11, a second punch 15, a blank holder (wrinkle press member) 20, which are a lower mold.

(Lower Mold)

Figure 3:
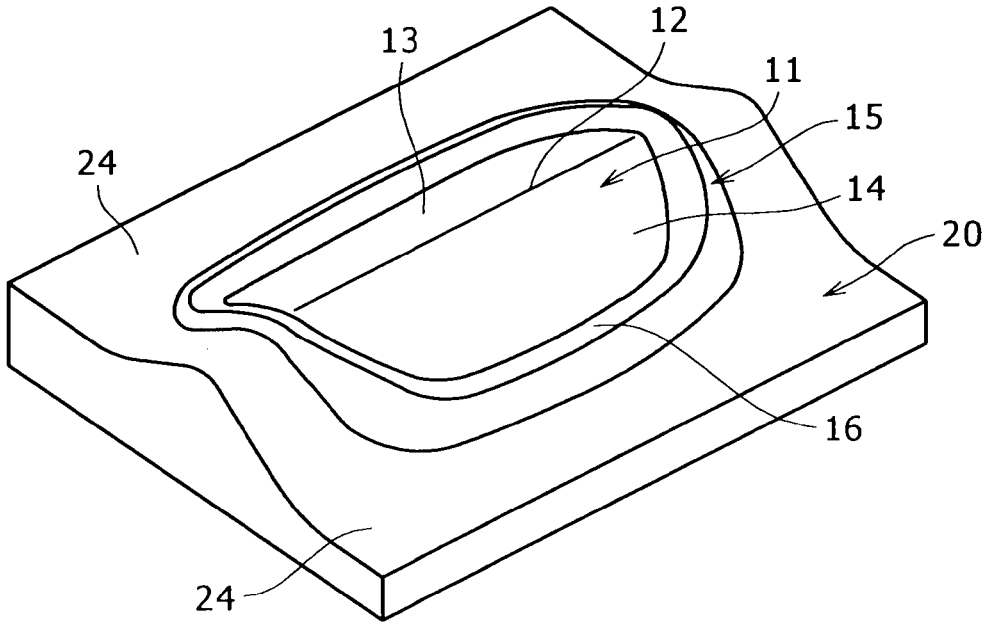
FIG. 3 Perspective view exhibiting an embodiment of a mold in relative with the present invention.
Figure 4:
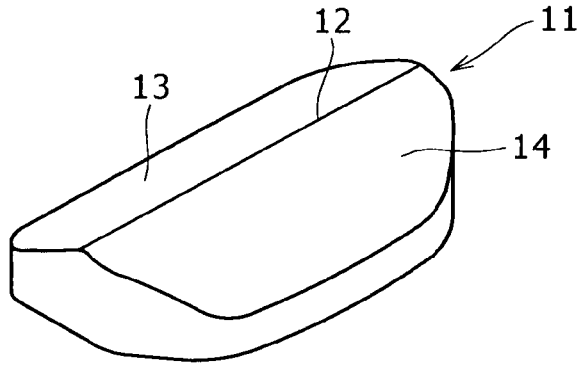
FIG. 4 Perspective view exhibiting an embodiment of a punch in relative with the present invention.

FIG. 3 exhibits a lower mold only and exhibits an aspect of a combination of the first punch (main body punch) 11 and the second punch (divided punch) 15 divided from the first punch 11 and moves (shifts) independently. The upper faces of these punches 11, 15 comprise product shape faces respectively which are engaged with form and shape faces in the center of the dice 22 which is the upper mold.

In other words, as a main body punch, the first punch 11 forms the center part of the formed panel (material sheet). More specifically, as partially exhibited by the perspective view in FIG. 4, the first punch 11 comprises, as product shape faces, a ridge line part 12 to shape the ridge line part (12 of FIG. 11) of the center part of the panel, and flat face parts 13, 14 to shape the flat face parts (3, 4 of FIG. 11) surrounding the ridge line part 12 of the panel.

Also, as a divided punch, the second punch 15 contacts the non-contact outer peripheral part (the part not contacting the first punch 11 until the vicinity of the bottom dead point of the panel) or, further, forms this non-contact outer peripheral part. More specifically, as partially exhibited by the perspective view in FIG. 5, the second punch 15 has, as a product shape face (excess material shape face described below), a nearly annular shape arranged around the first punch 11.

Figure 5:
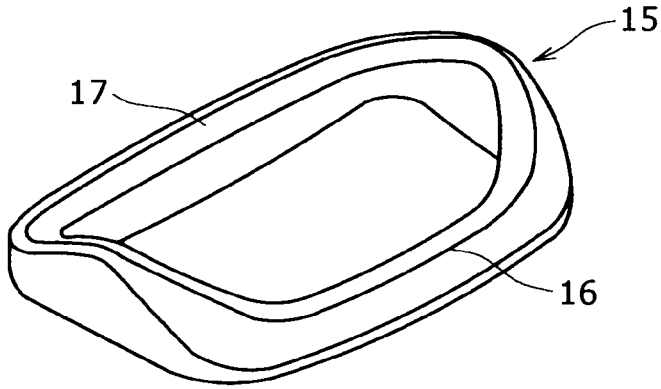
FIG. 5 Perspective view exhibiting an embodiment of a divided punch in relative with the present invention.

However, the peripheral shape (outline) and the quantity of the second panel 15 should be decided according to the peripheral shape (outline) of the first punch 11, and are not necessarily be an annular shape and one number only as FIG. 5. In this regard, it may be, for example, a partial annular shape comprising a plurality of punches or parts (sections) surrounding the periphery of the first punch 11 partially.

The perspective view 8 of the punches 11, 15 as mounted on a bolster exhibits the mounting conditions of these punches 11, 15. The punch 11 is mounted on the bolster rigidly. On the other hand, the second punch 15 is joined to the bolster through gas springs 18 and the like arranged in required positions in a required quantity, and is configured to fall down if a compressive force is applied to the second punch 15 from the upper side. As another aspect, the second punch 15 may be provided in plural numbers as described above and constituted to be able to respectively proceed/retract (able to ascend/descend) independently with respect to an upper mold through a respective independent drive unit such as hydraulic drive.

Figure 6:
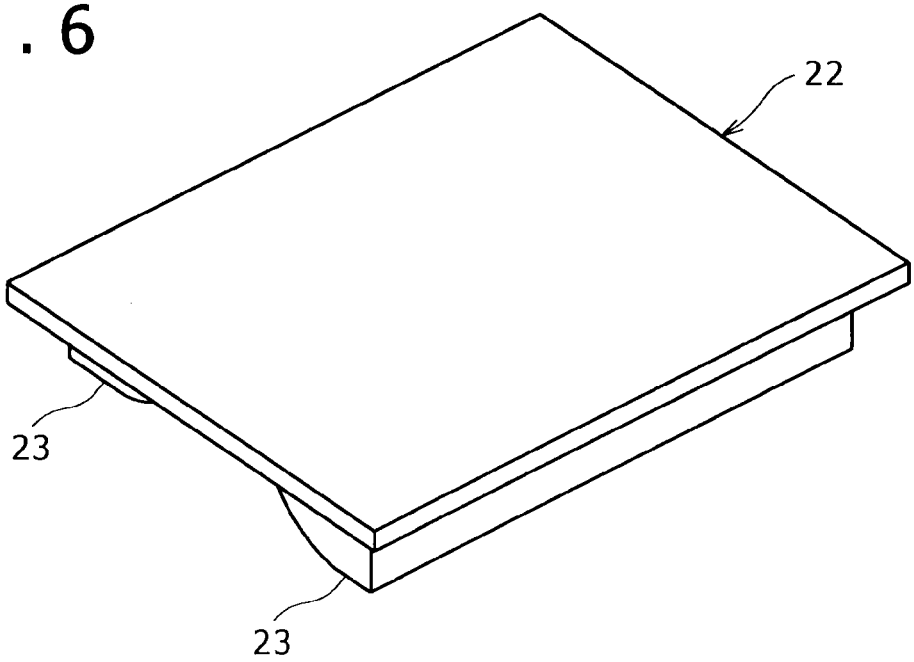
FIG. 6 Perspective view exhibiting an embodiment of a sheet holder in relative with the present invention.
Figure 7:
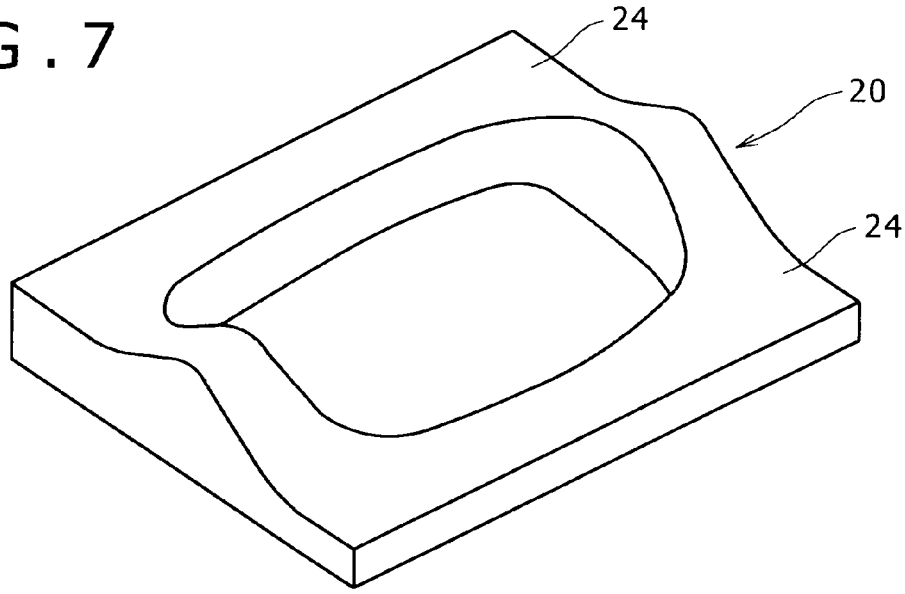
FIG. 7 Perspective view exhibiting an embodiment of a sheet holder in relative with the present invention.
Figure 8:
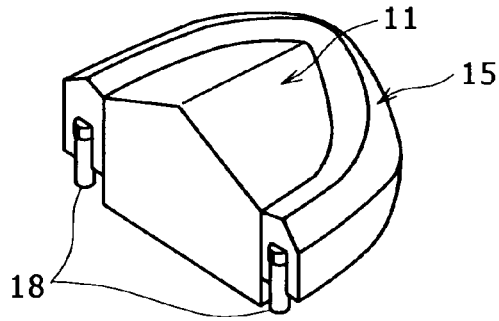
FIG. 8 Perspective view exhibiting an embodiment of a divided punch in relative with the present invention.

As exhibited in the perspective view in FIG. 6, the dice 22 of the upper mold comprises a center part corresponding to the center of the formed product and wrinkle press faces 23, 23 respectively. Also, as exhibited in the perspective view in FIG. 7, the blank holder (wrinkle press member) 20 comprises wrinkle press faces of 24, 24 respectively. Further, the blank holder 20 is held by cushion pins (not shown), and an upward force generated by a hydraulic mechanism in the lower part of the press device is transferred to the blank holder 20 through the cushion pins and is used for holding the blank as the wrinkle press force.

(Upper Mold)

Describing an upper mold using FIG. 1 (*a*), on the other hand, the dice 22 is mounted on a slide (not shown) connected to a lifting and lowering device. A product shape face 22*a* is shaped on a lower surface of the dice 22. Also, in the outermost peripheral part of the dice 22, frame-shape wrinkle press faces 23, 23 are shaped in positions respectively opposing with the wrinkle press faces 24, 24 of the blank holder 20 of the lower mold.

Also, in the positions of the dice 22 corresponding to excess material shape faces 16, 17 of the second punch 15 of the lower mold, excess material shape faces 22*b*, 22*c*, to respectively form each excess material part 35, 36 of a further outer peripheral side of flat face parts 33, 34 of a sheet 30 by co-working with the second punch 15, are respectively provided.

(Forming Method)

The press forming method of an aluminum alloy sheet of the present invention will be described using the sectional view of the press device FIG. 1 (*a*), (*b*), (*c*), (*d*). In the press device of FIG. 1, as a premise, the punch 11 of the lower side 11 is to be fixed to the bolster 21 and is not to move, and forming is to be performed with the upper dice 22 side descending (exhibited by an arrow downward). In this regard, the lower punch 11 side may be made ascend, in short, those wherein the punch 11 and dice 22 are to move relatively.

FIG. 1 (*a*) exhibits the state before the start of forming by the punch wherein the aluminum alloy sheet 30 is set to the press device. In FIG. 1 (*a*), an ultimate peripheral edge part 31 of the sheet 30 is held with an appropriate wrinkle press force by wrinkle press faces 23, 23 positioned in the peripheral part of the dice 22 and the wrinkle press faces 24, 24 of the blank holder 20. This wrinkle press force may be in the range applied in the press forming of the ordinary aluminum alloy sheet. Here, the blank holder 20 is kept at the upper limit position by cushion pins 25 respectively before the aluminum alloy sheet 30 is set.

(Action of the Second Punch)

FIG. 1 (*b*) exhibits the state wherein the dice 22 descended to the position 65 mm above the position of the bottom dead point of forming. In accordance with descent of the dice 22, the blank holder 20 performs falling down movement keeping the state of the aluminum alloy sheet 30 being held by co-working of the wrinkle press face 24 being a part thereof and a wrinkle press face 23 positioned in the periphery of the dice 22.

The FIG. 1 (*b*) exhibits the state the second punch 15, prior to forming of the first punch 11, has started contacting or forming excess material parts 35, 36 of the sheet (corresponding to excess material parts 5, 6 of the formed product panel described below) which are the non-contact outer peripheral parts (the part not contacting the first punch 11 until the vicinity of the bottom dead point of the panel).

In this state, excess material shape faces 22*b*, 22*c* of the dice 22 correspond to the excess material shape faces 16, 17 of the second punch 15, and the second punch 15 and the dice 22 co-work and start respectively contacting the respective excess material part 35, 36 of the sheet 30 (further outer peripheral side of the flat face parts 33, 34) or, further, forming these parts.

For enabling it, the second punch 15 is made to be the state of floating beforehand by a gas spring 18 from a bolster 21 to allow starting to contact or form the excess material parts 35, 36 of the sheet (the non-contact outer peripheral parts) before the first punch 11. In other words, the relative position of the second punch 15 with respect to the first punch 11 is shifted to the dice 22 side beforehand compared with the relative position of the second punch 15 with respect to the first punch 11 at the bottom dead point of the press.

Here, if the effect of enabling eliminating the non-contact outer peripheral part, restraining wrinkle deformation of the end part of the material sheet and controlling the tensile force applied to the material sheet can be exerted, it is appropriately selected whether to make the second punch 15 merely contact the excess material parts (the non-contact outer peripheral parts) 35, 36 of the sheet or further, to positively form the parts thereof. In the ordinary press forming condition, the effect of enabling eliminating the non-contact outer peripheral parts, restraining wrinkle deformation in the end part of the material sheet and controlling the tensile force applied to the material sheet is easy to be exerted, when the second punch not only contacts the non-contact outer peripheral part (the part not contacting the first punch until the vicinity of the bottom dead point of the panel) but further, forms this part.

(Forming of the Sheet by the First Punch)

In this state of FIG. 1 (*b*), the first punch 11 has not yet started forming of the part 32 (2) corresponding to the ridge line part which is the center part of the sheet 30. However, the dice 22 is still descending toward the first punch 11, and after the state of FIG. 1 (*b*), the first punch 11 has started forming of the sheet 30. In other words, product shape faces 12, 13, 14 of the first punch 11 form a ridge line part 2 of the center part of the panel (corresponding part 32 of the sheet) and the flat face parts 3, 4 surrounding the ridge line part 2 of the panel (corresponding parts 33, 34 of the sheet) by co-working with a product shape face 22*a* of the dice.

At this time, as described above, the second punch 15 and the dice 22, which have already started forming of each excess material parts 35, 36 of the sheet 30, restrain the sheet 30, which is formed by the first punch 11, by two positions of respective contact point of the excess material shape faces 16, 17 of the second punch 15 and the excess material shape faces 22*b*, 22*c* of the dice 22. In other words, in forming by the first punch 11, they act so that tensile force is applied from the circumference to the part 32 in the sheet 30 corresponding to the ridge line part 2 of the center part of the panel.

Thus, when the first punch 11 forms the aluminum alloy sheet 30 by co-working with the dice 22, it becomes possible to form while the part 32 corresponding to the curved faces 3, 4 of the panel in the sheet 30 is applied with tensile force from the circumference and is restrained.

Figure 12A:
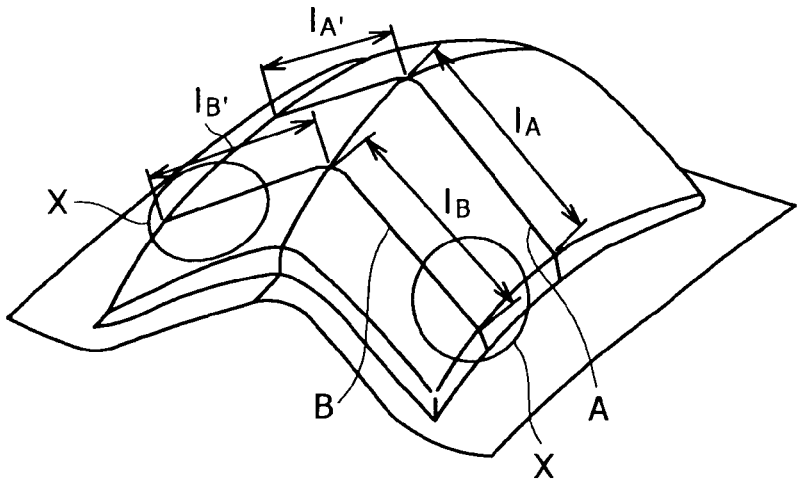
FIG. 12 Sectional view of a press device exhibiting a conventional forming method.
Figure 12B:
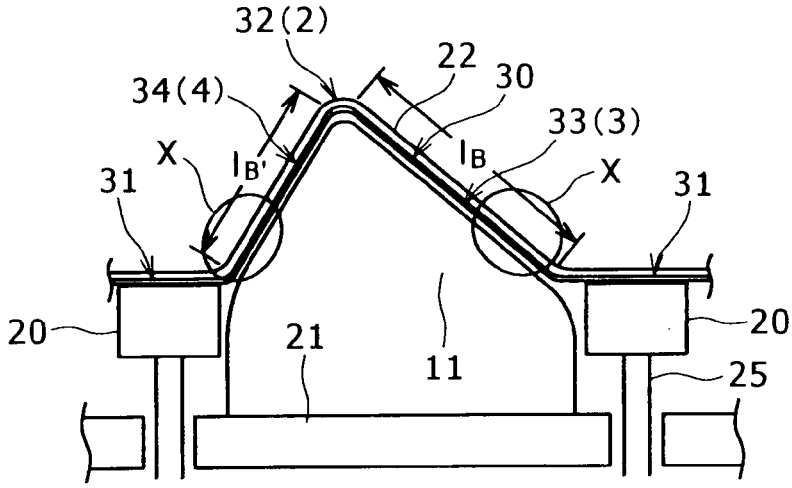

In addition, by adjusting location and degree of forming of each excess material parts 35, 36 of the sheet 30 by the second punch 15, even if the difference of the lengths of sections A, B of the sheet 30 in FIG. 12 described above where the tensile force described above is to be applied is big as the luggage outer panel and the like which is the object of the present invention, tensile force can be applied over the entire panel.

Therefore, even if the difference of the lengths of sections A, B of the sheet 30 is big, at the time of being formed by the first punch 11 and the dice 22, the non-contact outer peripheral part is eliminated and wrinkles become hard to occur in the part corresponding to the flat face parts 3, 4 of the luggage outer panel.

In the example of FIG. 1 *b*, it is configured that the second punch 15 is made to be the state of floating beforehand by a gas spring 18 from a bolster 21 to allow to start forming of the sheet before the first punch 11, and contacting and forming of the second punch 15 start before forming of the first punch starts.

For enabling it, the second punch 15 is made to be the state of floating beforehand by a gas spring 18 from a bolster 21 to allow starting to contact or form the excess material parts 35, 36 of the sheet (the non-contact outer peripheral parts) before the first punch 11. In other words, the relative position of the second punch 15 with respect to the first punch 11 is shifted to the dice 22 side beforehand compared with the relative position of the second punch 15 with respect to the first punch 11 at the bottom dead point of the press.

Here, the position of the second punch 15 may be being set so that forming of the second punch 15 starts after the first punch 11 starts forming. Also, the material and the second punch may be made contact the material in an early stage by making the second punch 15 shift to the dice side compared with the first punch 11 at one point of time during forming. This contact timing of the second punch and the material is conveniently selected according to the tensile force applied to the product to be formed. What is important is that the relative position of a movable punch with respect to the first punch is shifted to the dice side compared with the position at the bottom dead point of the press at one point of time during press forming so that prevention of breakage at the bottom dead point and co-existence of restraining of the material and application of tensile force are possible at an early stage during press forming.

FIG. 1 (*c*) exhibits the state wherein the dice 22, after the state of FIG. 1 (*b*) described above, further moved (descended) to the position 32 mm above the bottom dead point of forming toward the first punch 11. In this state, wrinkle inhibiting action by the second punch 15, that is, the function of contacting or forming the excess material parts 35, 36 of the sheet (the non-contact outer peripheral parts) by the second punch 15, is enhanced in accordance with the progress of contacting or forming.

And it is maximized at the position the excess material shape faces 22*b*, 22*c* of the dice 22 and the excess material shape faces 16, 17 of the second punch 15 hold without a gap the excess material parts (the non-contact outer peripheral parts) 35, 36 shaped in the aluminum alloy sheet 30. However this function is not required to be enhanced further in the forming process thereafter, and it can be approximately in a similar degree thereafter. In other words, in or after the state of FIG. 1 (*c*) wherein the first punch 11 relatively moved (ascended) up to 32 mm toward the dice 22, application of tensile force of a similar degree only is enough. As described above, whether a wrinkle occurs or not in the part corresponding to the flat face parts 3, 4 of the luggage outer panel is decided in the former half of this forming process until FIG. 1 (*c*) by the first punch 11.

(Descent of the Second Punch)

In this regard, in the present invention, in the latter half of this forming process, as forming proceeds and the dice 22 gets close to the bottom dead point, the second punch 15 is lowered with interlocking with the dice 22 keeping the state wherein the aluminum alloy sheet 30 is held. In other words, after the state of FIG. 1 (*c*) wherein the dice 22 moved (descended) to the position described above wherein the excess material parts 35, 36 shaped in the aluminum alloy sheet 30 are held in co-working with the excess material shape faces 22*b*, 22*c* and the excess material shape faces 16, 17 of the second punch 15, as forming proceeds and the dice 22 gets close to the bottom dead point, the second punch 15 is lowered with interlocking with the dice 22 keeping the state wherein the aluminum alloy sheet 30 is held. This lowering is performed with the gas spring 18 supporting the second punch 15 being made shrink by descent of the dice 22.

Thus, the function of forming of 35, 36 of the excess material parts or applying the tensile force (restraining) by the second punch 15 and the dice 22 is maintained at a constant level. In other words, as forming proceeds and the first punch 11 gets close to the bottom dead point, the second punch 15 stops the movement toward the dice 22 and maintains the state wherein the sheet is held in the gap against the dice 22. Thus, unnecessary increase of tensile force in the latter half of forming for the parts of 33, 34 of the sheet is eliminated, forming of the latter half by the first punch 11 is performed in this state, and stretch forming of the panel is finished as FIG. 1 (*d*). Consequently, it becomes possible to control the reduction ratio of the sheet thickness to a similar degree to that of the ordinary stretch forming without decreasing the sheet thickness much.

Further, although forming is performed in the state wherein the material is held perfectly by the second punch 15 and the dice 22 in FIG. 1 (*c*), perfect holding is not necessarily be required. For example, the sheet may be formed by the second punch 15 in the state wherein a given clearance is provided between the second punch 15 and the dice 22, in other words, the state wherein the second punch 15 only touches the sheet or the state wherein the clearance is provided.

In such a state wherein the second punch 15 only touches the sheet or the state wherein the sheet is formed by the second punch 15 while the clearance is provided, the tensile force applied to the material sheet becomes little compared with the case of perfect holding as FIG. 1 (*c*). However, because the second punch is in contact with the material sheet, deformation restraining effect of the material sheet and tensile force applying effect by friction resistance are secured. As described above, movement of the second punch can be conveniently selected according to forming condition to make both breakage of the material sheet and occurrence of a wrinkle co-exist.

Figure 13:
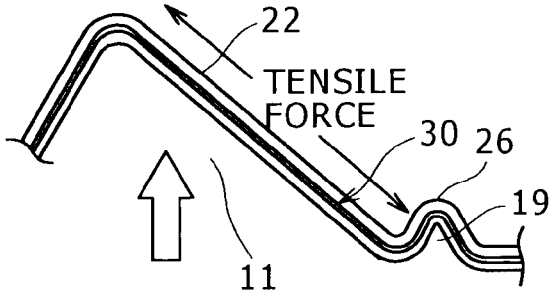
FIG. 13 Partial sectional view of a press device exhibiting a conventional forming method.

If the function of applying the tensile force by forming the excess material from the early stage of forming without using the descending action of the second punch as described above is to be secured, the height of the excess material, in particular, is to be made high as described above in the excess material shape part 19 integrally shaped with the punch and the excess material shape part 26 of the dice as FIG. 13. In this method, however, because the depth of forming at the excess material shape parts 26, 19 becomes extremely deep in the vicinity of the bottom dead point of forming, excessive tensile force is forcibly applied to the aluminum alloy sheet. Therefore, as described above, thickness reduction ratio becomes large which becomes the cause of the crack of the sheet during forming.

In FIG. 1 (*d*), the final stage of stretch forming (state at the bottom dead point of forming) is exhibited. As shown in a panel formed product 1 exhibited in FIG. 1 (*d*), 2 is the ridge line part 2 (corresponding part 32 of the sheet) of the center part of the panel, and 3, 4 are the flat face parts (corresponding parts 33, 34 of the sheet) surrounding the ridge line part 2. Also, 5, 6 are the characteristic excess material parts (corresponding parts 35, 36 of the sheet: the non-contact outer peripheral parts) formed by the excess material shape faces 16, 17 of the divided punch 15 and the excess material shape faces 22*b*, 22*c* of the dice 22.

Further, although the upper faces of the excess material shape faces 16, 17 of the second punch 15 are in a flat shape in FIG. 1 (*d*), the shape is not necessarily be flat but may be in a convex shape with nearly semicircular top face. Also, unevenness or step may be provided in the contact face of the second punch 15 with the aluminum alloy sheet. In addition, unevenness or step corresponding to the unevenness or step described above may be provided in the excess material shape faces 22*b*, 22*c* (contact face with the aluminum alloy sheet) of the dice 22 side corresponding thereto. By forming the sheet part in the vicinity of the bottom dead point with these unevenness or steps, the effects such that tensile force is applied to the sheet positively, surface strain of the panel formed product is eliminated, and shape accuracy is further improved can be expected.

Figure 11:
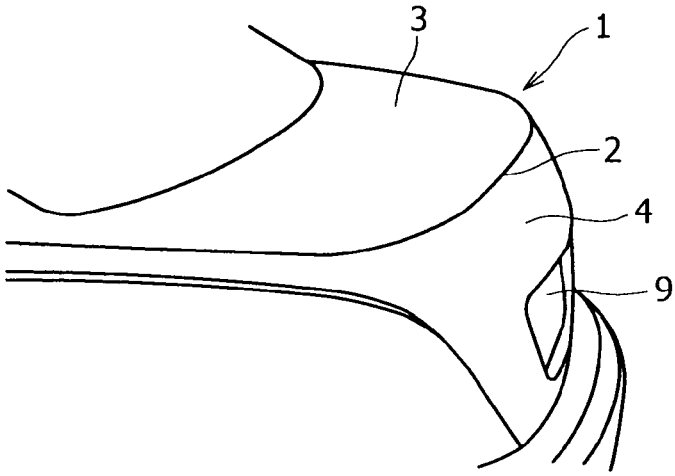
FIG. 11 Perspective view exhibiting an example of an outer luggage panel.

For the panel formed product which has been stretch formed as described above, further, thereafter, the recessed part (seat) 5 where a number plate is mounted is formed, the excess material parts 5, 6 and the ultimate peripheral edge part and the like are removed by trimming work, and it is finished into the automobile body outer panel and the like made of an aluminum alloy sheet such as the luggage outer panel exhibited in the FIG. 11 and the like, as a panel product.

In the present invention, as described above, prevention of occurrence of a wrinkle and prevention of occurrence of a crack at the time of stretch forming of a panel can be made co-exist. As a result, even the large panel, which is of a shape difficult to form such as the automobile body outer panel and the like made of an aluminum alloy sheet such as the luggage outer panel and the like whose ridge line part has a semicircular character line, becomes possible in forming. Consequently, the present invention is applied and preferable for the automobile body outer panel made of an aluminum alloy sheet selected from a hood, fender, door, luggage (trunk lid), roof and the like which are representative examples of these large panels of the shape difficult to form.

(Aluminum Alloy)

For the aluminum alloy used in the present invention, an aluminum alloy material, which is selected from a 3000 series, a 5000 series, a 6000 series, a 7000 series and the like stipulated or included in AA or JIS Standards in accordance with the required property of the panel use such as stiffness, strength, formability, anti-corrosion property and the like, is appropriately selected. However, among them, it is suitably applied to an Al—Mg—Si series (6000 series) aluminum alloy sheet, which is commonly used for an automobile body outer panel and the like made of aluminum alloy, is stretch formed at a high strength of 130 MPa or above of 0.2% proof strength to improve bake hardening performance and is being highly required of improvement of the formability.

EXAMPLE

The examples of the present invention will be described below. A high strength aluminum alloy sheet of AA6061-T4 material, which is more difficult in stretch forming among aluminum alloy, was stretch formed into the luggage outer panel 1 of the shape exhibited in FIG. 11. And, the condition of occurrence of a wrinkle of the formed product was investigated. For this aluminum alloy sheet, 0.2% proof stress was 150 MPa, sheet thickness was 1.0 mm, dimension was 1,840 mm width×1,450 mm length.

The luggage outer panel 1 formed has the large ridge line part 2 of 200 mm height extending in the vehicle width direction and the flat face parts 3 (380 mm length), 4 (420 mm length) surrounding the ridge line part 2 in the center part (top part) of the panel. Further, the ridge line part 2 has the character line with 100 DEG bent angle formed between the flat face parts 3, 4, and 3,000 mm radius of curvature and 1,250 mm length semicircular shape in plan view.

With regard to the press device used in the example of the invention, a stretch forming test was performed using the press device 10 wherein the punch for forming the excess material had been divided as described in FIG. 1, FIGS. 2-8. The panel formed product at 65 mm and 32 mm above the bottom dead point of the example of the invention is respectively exhibited in perspective view in FIG. 9 (*a*), (*b*). In the panel formed product exhibited in FIG. 9 (*a*), (*b*), 2 is the ridge line part 2 (corresponding part 32 of the sheet) of the center part of the panel, and 3, 4 are the flat face parts (corresponding parts 33, 34 of the sheet) surrounding the ridge line part 2. Also, 5, 6 are the characteristic excess material parts (corresponding parts 35, 36 of the sheet: the non-contact outer peripheral parts) formed by the second punch 15.

Figure 9A:
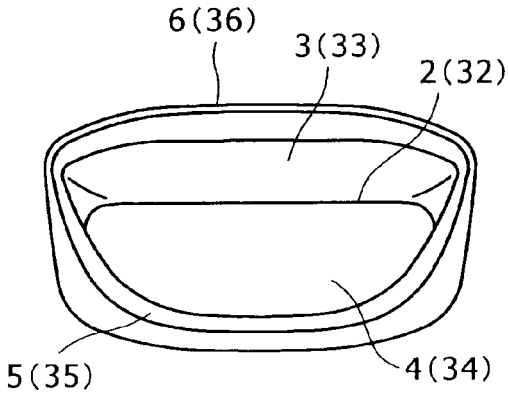
FIG. 9 Perspective view exhibiting a formed product by a forming method of the present invention.
Figure 9B:
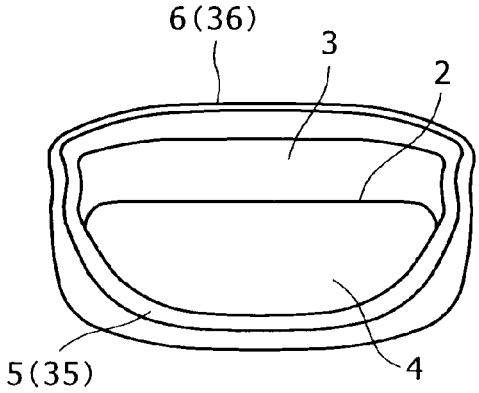

As exhibited in FIG. 9 (*a*), (*b*), in the example of the invention, a wrinkle and crack did not occur in the ridge line part 2 of the center part of the panel and the flat face parts 3, 4 surrounding the ridge line part 2, inclusive of the portion X wherein the wrinkle is liable to occur, at 65 mm and 32 mm above the bottom dead appoint and, although not shown, in the formed product panel at the bottom dead point. Further, the smoothness of the surface of the final panel formed product and the shape accuracy including the character line of the ridge line part were excellent.

Also, the maximum sheet thickness reduction ratio (sheet thickness reduction ratio against the original sheet thickness) of the ridge line part 2, wherein sheet thickness reduction became large at maximum, of the formed product panel at the bottom dead point of the example of the invention was approximately 18.7% which was a little bit larger than the maximum sheet thickness reduction ratio of the conventional example described below. This is less than 20% which is the upper limit of the sheet thickness reduction ratio wherein a crack liable to occur in stretch forming of the luggage outer panel made of an aluminum alloy, and is within the allowable range.

On the other hand, in the conventional example, a stretch forming test was performed using the press device with a conventional ordinary integral type punch 11 described in FIG. 12. The panel product of the conventional example is respectively exhibited in perspective view in FIG. 10 (*a*), (*b*). In the conventional panel formed product exhibited in FIG. 10 (*a*), (*b*), 2 is the ridge line part 2 (corresponding part 32 of the sheet) of the center part of the panel, and 3, 4 are the flat face parts (corresponding parts 33, 34 of the sheet) surrounding the ridge line part 2.

Figure 10A:
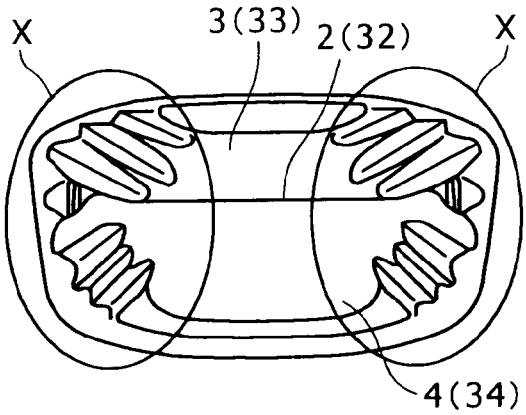
FIG. 10 Perspective view exhibiting a formed product by a conventional forming method.
Figure 10B:
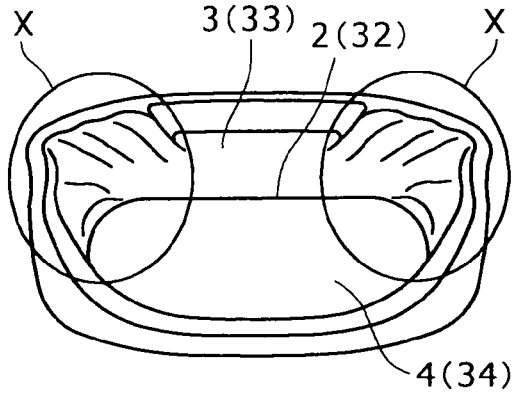

As exhibited in FIG. 10 (*a*), (*b*), in the conventional example, many large wrinkles occur in the portion X, wherein the wrinkle is liable to occur, of the ridge line part 2 of the center part of the panel and the flat face parts 3, 4 surrounding the ridge line part 2 at 65 mm and 32 mm above the bottom dead appoint and, although not shown, in the formed product panel at the bottom dead point. As a result, the smoothness of the surface of the final panel formed product and the shape accuracy including the character line of the ridge line part were inferior. Also, the maximum sheet thickness reduction ratio of the ridge line part 2 of the formed product panel of the conventional example at the bottom dead point was approximately 16.7%, and was close to 20% which was the upper limit of the sheet thickness reduction ratio wherein a crack liable to occur.

From these examples, effect of inhibiting a wrinkle in forming the panel which is difficult to form in the forming method of the present invention is endorsed. Further, in the example, formability improving effect is endorsed on a 6000 series which is most difficult in forming. As a result, even in the case it is applied to an aluminum alloy sheet of a 3000 series and a 5000 series which are easier in forming than a 6000 series, formability surely improves. In these aluminum alloy, the mechanical properties such as tensile strength, proof stress, elongation and the like of course change according to the alloy composition and the thermal refining (heat treatment) conditions. Therefore, the degree of occurrence of a wrinkle described above differs, but the mechanism itself of occurrence of a wrinkle is not dependent on these mechanical properties and is common, and the wrinkle inhibiting mechanism of the present invention against it is common, which is the reason.

INDUSTRIAL APPLICABILITY

According to the present invention, a press forming method of an aluminum alloy sheet and a press device capable of forming a large panel, which is an automobile body outer panel such as a luggage outer panel and the like, has the non-contact outer peripheral part, and is of a shape difficult in forming, can be provided. Consequently, usage of an aluminum alloy sheet as a forming material is largely expanded to the usage of outer panel formed products of automobiles and the like, and the industrial value is large.

The invention claimed is:

1. A method of press forming an aluminum alloy sheet into a formed product panel having an arcuate ridge line and at least two curved faces surrounding the ridge, using a press device comprising a die, a blank holder at an outer periphery of the die, a first punch having an arcuate ridge line part for shaping the arcuate ridge line of the panel, and a substantially annular second punch surrounding the first punch, wherein the second punch is movable relative to the first punch in the direction toward and away from the die independently of the movement of the first punch toward and away from the die, and wherein the arcuate ridge line is curved in the direction toward and away from the die, the method comprising the steps of:

positioning an aluminum alloy sheet between the die, on one side of the aluminum alloy sheet, and the first and second punches on another side of the aluminum alloy sheet;

holding an outer peripheral part of an aluminum alloy sheet between the die and the blank holder;

positioning the second punch at a position advanced toward the die relative to the first punch;

causing at least one of the die and the first punch to be relatively moved toward one another toward a dead bottom point, beginning at a time when the second punch is at the position advanced toward the die relative to the first punch, whereby the aluminum alloy sheet is engaged between the die and the advanced second punch before the arcuate ridge line is formed between the die and the first punch; and thereafter continuing to move at least one of the die and the first punch toward one another to the dead bottom point, to form the formed product panel having the arcuate ridge line, wherein at the dead bottom point, the second punch is shifted away from the position advanced toward the die relative to the first punch.

2. The method of press forming an aluminum alloy sheet according to claim 1, wherein the press formed aluminum alloy sheet is Al-Mg-Si series aluminum alloy of 130 MPa or more of 0.2% proof stress.

3. The method of press forming an aluminum alloy sheet according to claim 1, wherein an unevenness or step is provided on the die and on a corresponding contact face of the second punch.

4. The method of press forming of an aluminum alloy sheet as set forth in claim 1 wherein the formed product panel is an automobile body outer panel.

* * * * *